US005880666A

United States Patent [19]

Matsuoka et al.

[11] Patent Number: 5,880,666

[45] Date of Patent: Mar. 9, 1999

[54] FUSE WITH PRESS-CONNECTING TERMINALS AND WIRE CUTTER

[75] Inventors: Naoki Matsuoka; Kenji Muramatsu, both of Shizuoka, Japan

[73] Assignee: Yazaki Corporation, Tokyo, Japan

[21] Appl. No.: 940,962

[22] Filed: Sep. 30, 1997

[30] Foreign Application Priority Data

Oct. 3, 1996 [JP] Japan ..... 8-263130

[51] Int. Cl.[6] ..... H01H 85/00

[52] U.S. Cl. ..... 337/186; 337/251; 337/254; 337/290; 337/413; 439/621

[58] Field of Search ..... 337/227, 251, 337/254, 268, 290, 1, 4, 142, 186, 401, 404, 413, 414; 439/621, 622, 425

[56] References Cited

U.S. PATENT DOCUMENTS 4,237,513 12/1980 Foldes ..... 337/298 X 4,679,877 7/1987 Ahroni ..... 337/198 X

FOREIGN PATENT DOCUMENTS 1-134935 9/1989 Japan ..... H02H 9/02

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A fuse 15 includes a housing 2 of an insulative resin having a lid 13 and a housing body 11, and a fuse body 1 having a melting portion formed between a pair of press-connecting terminals 4 and 5 arranged in a staggered manner, the fuse body being received in the housing 2. A sheathed wire is press-connected to and retained by the press-connecting terminals 4 and 5 of the fuse body 1, a portion of the sheathed wire, mounted between the press-connecting terminals 4 and 5, being cut, to thereby provide a fuse which has a simple construction, and can be easily mounted at an existing circuit, and also to provide a method of mounting such a fuse.

8 Claims, 4 Drawing Sheets

FUSE WITH PRESS-CONNECTING TERMINALS AND WIRE CUTTER

BACKGROUND OF THE INVENTION

This invention relates to a fuse incorporated in an electric circuit in an automobile or the like so as to prevent an excess current from continuing to flow in the event of an abnormal condition such as a short-circuit, and the invention also relates to a method of mounting such a fuse.

Conventionally, a fuse, incorporated in an electric circuit, has a capacity corresponding to an allowable current of a load, and when the user adds a new load, or exchanges the load with a different load, it is necessary to add a new fuse so as to protect the circuit.

For example, in an electric system of an automobile, electric loads, such as a radio, a television set, a car navigation device and a clock, are connected in a parallel manner to a power source via a junction box containing fuses. The maker uses appropriate fuses corresponding to these loads associated with the electric system of the automobile.

When the user adds a new electric part, or exchanges the electric part with a new electric part of a smaller load, it is necessary to mount another fuse at its electric circuit. For example, when exchanging the electric part with a new electric part having a better performance and a smaller load, a wire of a circuit to be taken out is branched by the use of a branch wire excess current protection device as disclosed in Japanese Utility Model Unexamined Publication No. 1-134935, and by doing so, the new electric part of a smaller load can be easily connected to this branch circuit.

However, when exchanging the electric part with the new electric part by the use of the above branch wire excess current protection device, the existing circuit, from which the new circuit branches off, becomes useless. If the existing circuit is used, a new fuse must be mounted at an intermediate portion of the existing circuit.

When the user adds a new electric part, another fuse must be mounted at the circuit.

However, in order to mount the fuse at an intermediate portion of the existing circuit, there is required an operation in which a wire is cut or severed, and its sheath is peeled, and a metal terminal is clamped to a conductor of the wire, and then this terminal is connected to a fuse body within a fuse holder. The fuse-mounting operation is cumbersome, and the conventional fuse holder is inferior in the efficiency of the operation.

SUMMARY OF THE INVENTION

It is therefore an object of this invention to provide a fuse which has a simple construction, and can be easily mounted at an existing circuit, and another object is to provide a method of mounting such a fuse.

The above object of the invention has been achieved by a fuse comprising:

a housing made of an insulative resin including a lid and a housing body; and a fuse body received in the housing, the fuse body having a pair of press-connecting terminals which are arranged in a staggered manner and to which a sheathed wire is press-connected to and retained, and a melting portion formed between the pair of press-connecting terminals;

wherein the sheathed wire comprises a pair of cut end portions formed by cutting a portion of the sheathed wire located between the pair of press-connecting terminals after the sheathed wire is mounted on the pair of press-connecting terminals.

In the above-mentioned construction, preferably, a projection is formed on an inner surface of the lid so as to hold cut end portions of the sheathed wire apart from each other when the lid is closed.

Further, in the above-mentioned construction, the melting portion of the fuse body may be embedded in the housing body of the housing.

In addition, the above object of the invention has been also achieved by a fuse comprising:

a housing made of an insulative resin including a lid and a housing body; and a fuse body received in the housing, the fuse body having a pair of press-connecting terminals to which a sheathed wire is press-connected and having a melting portion formed between the pair of press-connecting terminals;

wherein the sheathed wire comprises a pair of cut end portions formed by cutting a portion of the sheathed wire located between the pair of press-connecting terminals after the sheathed wire is mounted on the pair of press-connecting terminals, and a projection is formed on an inner surface of the lid so as to hold the cut end portions of the sheathed wire apart from each other when the lid is closed.

Preferably, the melting portion of the fuse body is embedded in the housing body of the housing by providing an integral molding construction.

Further, the above object of the invention has been achieved by a mounting method for mounting on a fuse in a desired circuit in which the fuse comprises: a housing made of an insulative resin including a lid and a housing body; a fuse body received in the housing, the fuse body having a pair of press-connecting terminals arranged in a staggered manner and having a melting portion formed between the pair of press-connecting terminals; the mounting method comprising the steps of:

press-connecting the sheathed wire to the pair of press-connecting terminals; and cutting a portion of thus press-connected sheathed wire located between the pair of press-connecting terminals.

In the above-mentioned method, a projection may be formed on an inner surface of the lid, and the mounting method may further comprises the steps of:

holding cut end portions of the sheathed wire apart from each other with the projection when the lid is closed.

Furthermore, the above object of the invention has been achieved by a mounting method for mounting on a fuse in a desired circuit in which the fuse comprises: a housing made of an insulative resin including a housing body and a lid with a projection on its inner surface; a fuse body received in the housing, the fuse body having a pair of press-connecting terminals and a melting portion formed between the pair of press-connecting terminals; the mounting method comprising the steps of:

press-connecting the sheathed wire to the pair of press-connecting terminals; and cutting a portion of thus press-connected sheathed wire located between the pair of press-connecting terminals holding cut end portions of the sheathed wire apart from each other with the projection when the lid is closed.

When the mounted portion of the sheathed wire between the press-connecting terminals is cut, a predetermined length of this mounted portion may be cut off.

DETAILED DESCRIPTION OF THE PREFERRED EMBODIMENTS

One preferred embodiment of a fuse of the present invention will now be described in detail with reference to the accompanying drawings.

Figure 1:
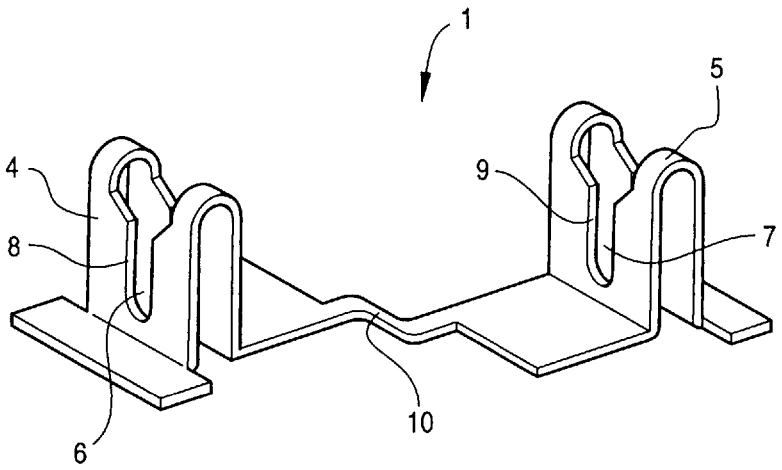
FIG. 1 is a perspective view showing a fuse body of a first embodiment of the invention.
Figure 2:
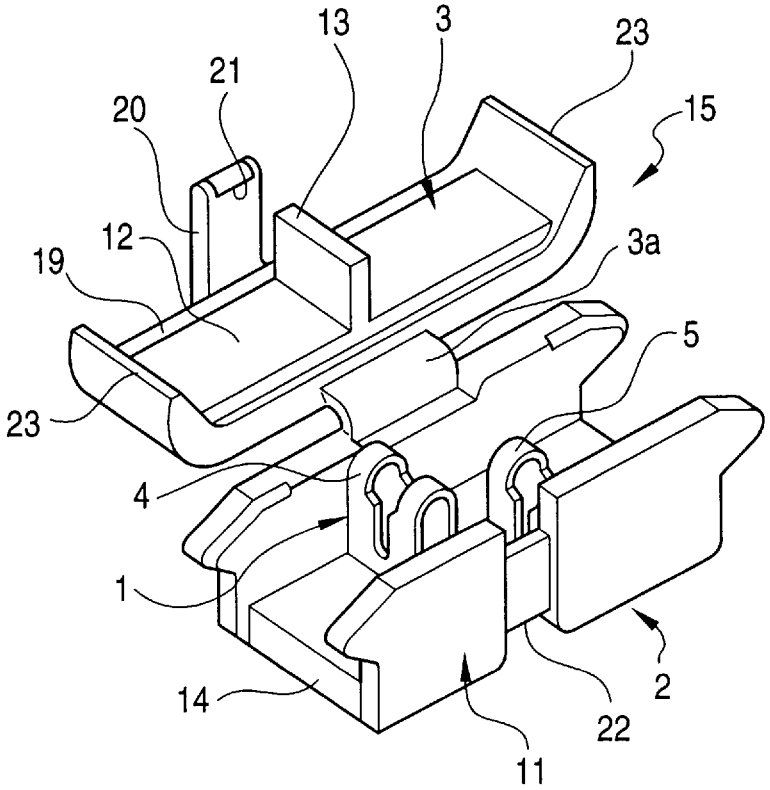
FIG. 2 is a perspective view showing the overall construction of the fuse in which the fuse body is received in a housing.

FIG. 1 is a perspective view showing a fuse body 1 of the first embodiment of the invention, and FIG. 2 is a perspective view showing the overall construction of the fuse 15 in which the fuse body 1 is received in a housing 2.

The fuse 15 comprises the fuse body 1 formed by pressing a metal sheet, and the housing 2 made of an insulative resin receiving the fuse body 1.

As shown in FIG. 1, the fuse body 1 comprises a pair of press-connecting terminals 4 and 5 arranged in a staggered manner, and a narrow melting portion 10 formed between these press-connecting terminals 4 and 5 so called as a crimping terminal in general. The press-connecting terminals 4 and 5 have vertically upstanding press-connecting grooves 6 and 7, respectively, and vertical inner edges of the press-connecting grooves 6 and 7 constitutes press-connecting blades 8 and 9.

Figure 5:
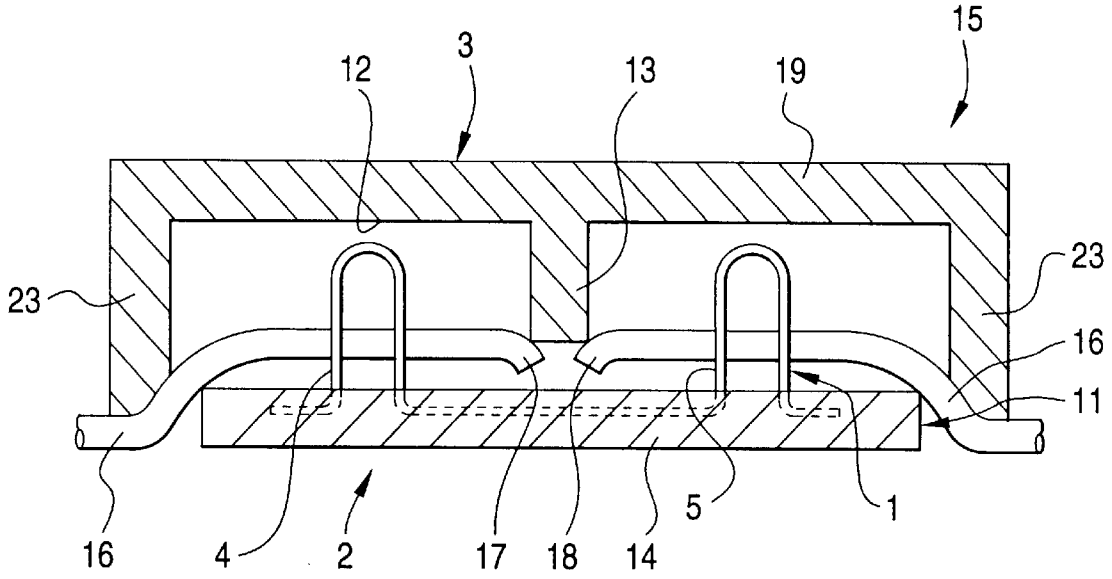
FIG. 5 is a vertical cross-sectional view in which the fused is mounted.

The housing 2 of a generally box-shape comprises a housing body 11 and a lid 3. The lid 3 is connected to the housing body 11 by a hinge 3*a*. Wire pressing portions 23 are formed in a projected manner on opposite ends of the lid 3, respectively, and when the lid 3 is closed, these wire pressing portions 23 press a sheathed wire 16 as shown in FIG. 5.

As shown in FIG. 2, a lock arm 20 is formed on a swingable side edge portion of the lid 3. A retaining projection 21 is formed at a distal end of this lock arm 20, to thereby be locked to a retaining portion 22 on the housing body 11. Preferably, the housing 2 is molded of a heat-resistant resin.

A projection 13 is formed on an inner surface 12 of the lid 3, and this projection 13 is inserted into a space between the press-connecting terminals 4 and 5 of the fuse body 1 when the lid 3 is closed. The fuse body 1 is integrally molded in the housing body 11 along a bottom plate 14 thereof, or is fitted into the housing body 11 after the housing body 11 is molded. In the case where the melting portion 10 of the fuse body 1 is embedded in the housing body 11 by integrally molding them, the melting portion 10 is less liable to be influenced by the outside temperature, and the generation of an arc during the melting of the melting portion 10 is suppressed.

Figure 3:
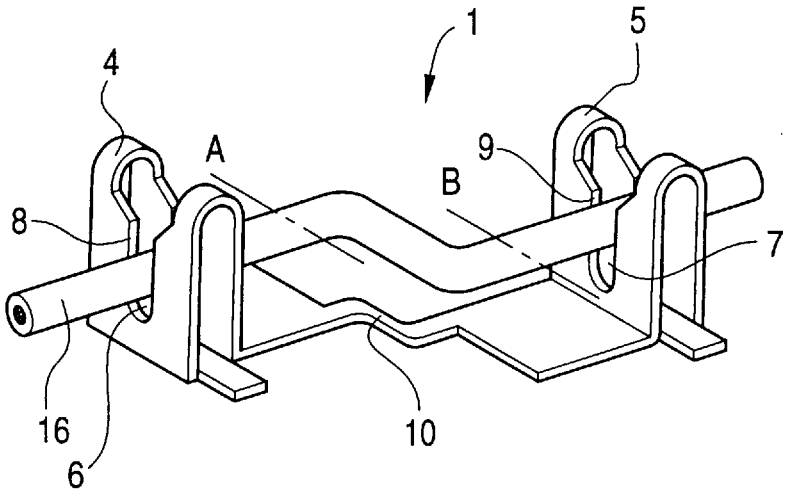
FIG. 3 is a perspective view showing a condition in which a sheathed wire is mounted on press-connecting terminals of the fuse body.
Figure 4:
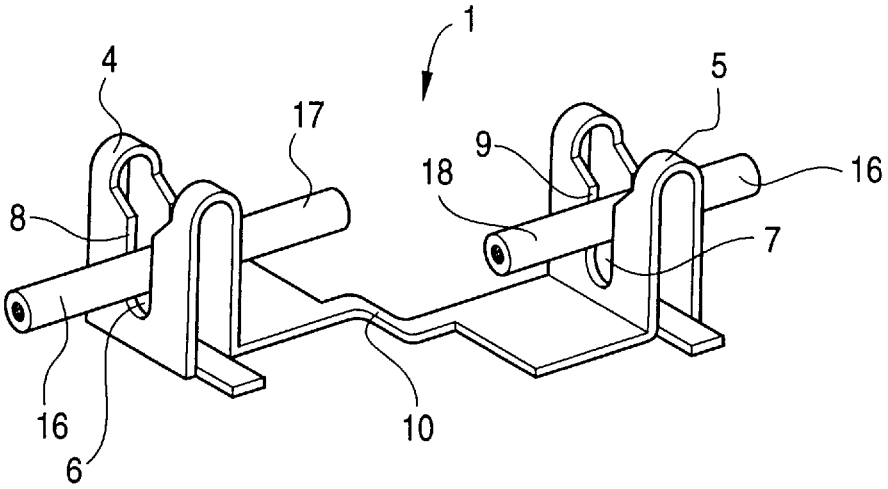
FIG. 4 is a perspective view showing a condition in which the mounted portion of the sheathed wire is cut.

A method of mounting the above fuse 15 of this embodiment at an intermediate portion of a circuit will now be described with reference to FIGS. 3 to 5. In FIGS. 3 and 4, an illustration of the housing 2 is omitted.

First, as shown in FIG. 3, a portion of the sheathed wire 16, to which the fuse is to be attached, is mounted between the press-connecting terminals 4 and 5 of the fuse body 1. Namely, the sheathed wire 16 is press-fitted into the press-connecting grooves 6 and 7 of the press-connecting terminals 4 and 5, so that the cutting blades 8 and 9 cut a sheath of the wire, thereby electrically connecting the press-connecting terminals 4 and 5 to a conductor in the wire.

As a result, the mounted portion of the sheathed wire 16 between the two press-connecting terminals 4 and 5, is bent into a generally crank-like configuration above the melting portion 10 since the upstanding press-connecting terminals 4 and 5 are arranged in a staggered manner as described above.

Then, the mounted portion of the sheathed wire 16 between the two press-connecting terminals is cut at its central portion, or a predetermined length of this mounted portion (indicated by dot-and-dash lines A and B in FIG. 3) is cut off, and therefore the sheathed wire 16 is severed into two parts, and at the same time these two parts are electrically connected together through the fuse body 1. Cut end portions 17 and 18 of the sheathed wire 16, cut at the central portion of the above mounted portion, are brought into a straight condition because of their elastic restoring force since the opposite ends of the mounted portion of the sheathed wire 16 are respectively press-connected to and retained by the press-connecting terminals 4 and 5 arranged in a staggered manner, and as a result the cut end portions 17 and 18 are kept spaced from each other.

Then, the lid 3 of the housing 2 is closed relative to the housing body 11. At this time, the projection 13, formed on the inner surface 12 of the lid 13, bends the two cut end portions 17 and 18 of the sheathed wire 16 downward, and holds them apart from each other, as shown in FIG. 5. Then, the lid 3 is retained on the retaining portion 22 of the housing body 11 by the retaining projection 21 of the lock arm 20, thus completing the mounting of the fuse 15.

Namely, in the fuse 15, the sheathed wire 16 is mounted on the press-connecting terminals 4 and 5, and is press-connected to and retained by these terminals 4 and 5, and then a portion of the sheathed wire 16, mounted between the two press-connecting terminals 4 and 5, is cut, and then the lid 3 is closed. With this simple mounting method, the fuse can be easily mounted at an intermediate portion of the existing circuit.

In the fuse 15 of this embodiment, when the lid 3 is closed, the projection 13 bends the two cut end portions 17 and 18 downward, and holds them apart from each other. However, in the case where the press-connecting terminals 4 and 5 are arranged in a staggered manner as in the fuse body of this embodiment, it is not always necessary to provide the projection 13 since the cut end portions 17 and 18 of the sheathed wire 16 are brought into a straight condition, and are kept spaced from each other because of their elastic restoring force.

Figure 6:
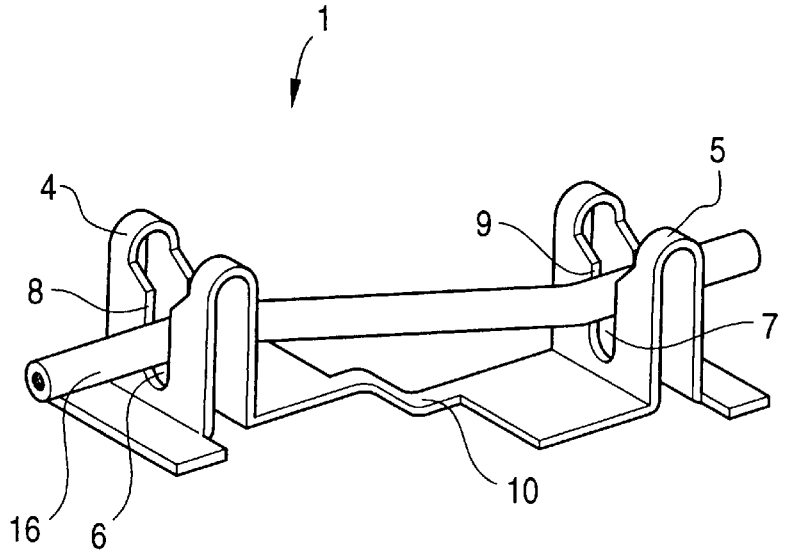
FIG. 6 is a perspective view of a modified form of the invention, showing a condition in which a sheathed wire is mounted on press-connecting terminals of a fuse body.

As shown in FIG. 6, there can be used an arrangement in which when the sheathed wire 16 is press-fitted into the press-connecting grooves 6 and 7 of the press-connecting terminals 4 and 5 to thereby cut the sheath by the cutting blades 8 and 9, thereby electrically connecting the press-connecting terminals 4 and 5 to the conductor in the sheathed wire, a portion of the sheathed wire 16, mounted between the press-connecting terminals 4 and 5, extends straight above the melting portion 10. In this case, also, the cut end portions of the sheathed wire 16, cut at the central portion of the above mounted portion, are brought into a straight condition because of their elastic restoring force since the opposite ends of the mounted portion of the sheathed wire 16 are respectively press-connected to and retained by the press-connecting terminals 4 and 5 arranged in a staggered manner, and as a result the cut end portions 17 and 18 are kept spaced from each other.

Figure 7:
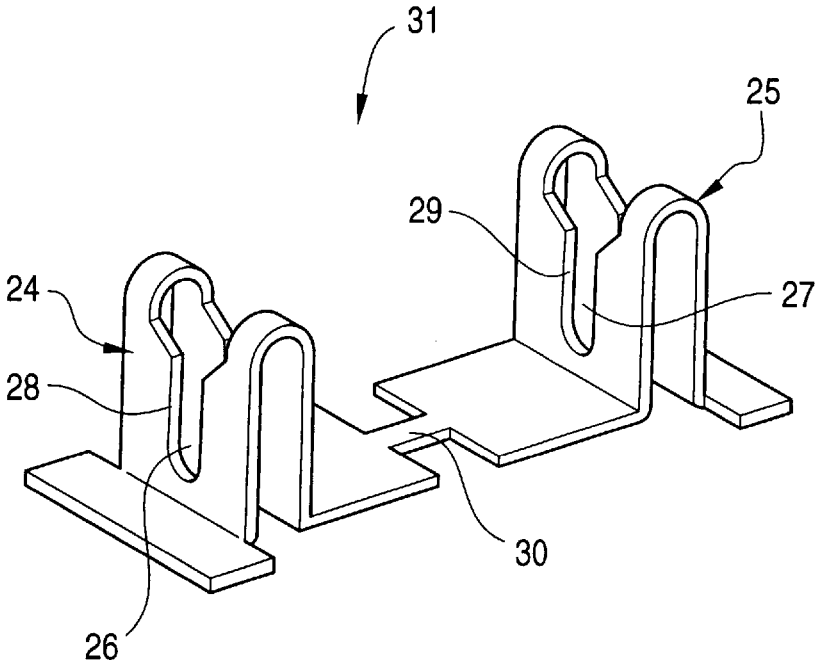
FIG. 7 is a perspective view showing a fuse body of a second embodiment of the invention.

FIG. 7 is a perspective view of fuse body 31 of a second embodiment of the invention.

The fuse body 31 comprises a pair of press-connecting terminals 24 and 25 arranged on a common straight line, and a narrow melting portion 30 formed between these press-connecting terminals 24 and 25. The press-connecting terminals 24 and 25 have vertical press-connecting grooves 26 and 27, respectively, and vertical inner edges of the press-connecting grooves 26 and 27 constitutes press-connecting blades 28 and 29. A housing, receiving this fuse body 31, is similar in construction to the housing 2 of the above first embodiment.

For mounting a fuse, having the fuse body 31 of this embodiment, at an intermediate portion of a circuit, a portion of the sheathed wire 16, to which the fuse is to be attached, is mounted between the press-connecting terminals 24 and 25 of the fuse body 31. Namely, the sheathed wire 16 is press-fitted into the press-connecting grooves 26 and 27 of the press-connecting terminals 24 and 25, so that the cutting blades 28 and 29 cut the sheath of the wire, thereby electrically connecting the press-connecting terminals 24 and 25 to the conductor in the wire.

As a result, the mounted portion of the sheathed wire 16 between the press-connecting terminals 24 and 25 extends straight above the melting portion 30 since the upstanding press-connecting terminals 24 and 25 are arranged on the common straight line as described above.

Then, the mounted portion of the sheathed wire 16 between the two press-connecting terminals is cut at its central portion, or a predetermined length of this mounted portion is cut off, and therefore the sheathed wire 16 is severed into two parts, and at the same time these two parts are electrically connected together through the fuse body 31.

Then, when a lid of the housing is closed, a projection 13, formed on an inner surface of this lid, bends two cut end portions of the sheathed wire 16 downward, and holds them apart from each other. In the fuse having the fuse body 31 of this embodiment, when the mounted portion of the sheathed wire 16 is merely cut at its central portion, it is essential to form the projection on the inner surface of the lid so as to hold the two cut end portions apart from each other.

The housing and fuse body of the fuses of the invention are not limited to those in the above embodiments, and various modifications can be made. For example, the melting portion of the fuse body can have any suitable shape, such as a U-shape, an S-shape and a constricted shape, depending on the load. By increasing only the thickness of the melting portion, the fuse of a desired rating can be provided.

As described above, in the fuse of the invention and the fuse mounting method of the invention, a portion of the sheathed wire is mounted between the press-connecting terminals, and the sheathed wire is press-connected to and retained by these terminals, and then the mounted portion of the sheathed wire is cut, and the lid is closed. With this simple mounting method, the fuse can be easily mounted at an intermediate portion of the existing circuit.

Therefore, when exchanging the electric part with a new electric part of a different load, the existing circuit can be used by mounting the fuse of the invention at the existing circuit, and there is no need to provide a new circuit. And besides, when the user adds a new electric part, the fuse of the invention can be easily mounted at an intermediate portion of the existing circuit, and therefore the new electric part can be easily protected from an excess current.

Thus, the fuse which can be easily mounted at the existing circuit, as well as the method of mounting the fuse, can be provided.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A fuse comprising:

a housing made of an insulative resin including a lid and a housing body; and a fuse body received in said housing, said fuse body having a pair of press-connecting terminals which are arranged in a staggered manner and to which a sheathed wire is press-connected to and retained, and a melting portion formed between said pair of press-connecting terminals;

wherein said sheathed wire comprises a pair of cut end portions formed by cutting a portion of said sheathed wire located between said pair of press-connecting terminals after said sheathed wire is mounted on said pair of press-connecting terminals.

2. The fuse according to claim 1 in which a projection is formed on an inner surface of said lid so as to hold cut end portions of said sheathed wire apart from each other when said lid is closed.

3. The fuse according to claim 1, in which said melting portion of said fuse body is embedded in said housing body of said housing.

4. A fuse comprising:

a housing made of an insulative resin including a lid and a housing body; and a fuse body received in said housing, said fuse body having a pair of press-connecting terminals to which a sheathed wire is press-connected and having a melting portion formed between said pair of press-connecting terminals;

wherein said sheathed wire comprises a pair of cut end portions formed by cutting a portion of said sheathed wire located between said pair of press-connecting terminals after said sheathed wire is mounted on said pair of press-connecting terminals, and a projection is formed on an inner surface of said lid so as to hold said cut end portions of said sheathed wire apart from each other when said lid is closed.

5. The fuse according to claim 4, in which said melting portion of said fuse body is embedded in said housing body of said housing.

6. A mounting method for mounting on a fuse in a desired circuit in which said fuse comprises: a housing made of an insulative resin including a lid and a housing body; a fuse body received in said housing, said fuse body having a pair of press-connecting terminals arranged in a staggered manner and having a melting portion formed between said pair of press-connecting terminals; the mounting method comprising the steps of:

press-connecting said sheathed wire to said pair of press-connecting terminals; and cutting a portion of thus press-connected sheathed wire located between said pair of press-connecting terminals.

7. The mounting method for a fuse in a desired circuit fuse according to claim 6, in which a projection is formed on an inner surface of said lid, said mounting method further comprises the steps of:

holding cut end portions of said sheathed wire apart from each other with said projection when said lid is closed.

8. A mounting method for mounting on a fuse in a desired circuit in which said fuse comprises: a housing made of an insulative resin including a housing body and a lid with a projection on its inner surface; a fuse body received in said housing, said fuse body having a pair of press-connecting terminals and a melting portion formed between said pair of press-connecting terminals; the mounting method comprising the steps of:

press-connecting said sheathed wire to said pair of press-connecting terminals; and cutting a portion of thus press-connected sheathed wire located between said pair of press-connecting terminals.

holding cut end portions of said sheathed wire apart from each other with said projection when said lid is closed.

* * * * *